US006176378B1

(12) United States Patent
Neubauer et al.

(10) Patent No.: US 6,176,378 B1
(45) Date of Patent: Jan. 23, 2001

(54) HOSIERY RETAINING DEVICE AND METHOD

(76) Inventors: Deborah Ann Neubauer, 595 Upper Merriman Rd., Akron, OH (US) 44303; Steven P. Okey, 2700 Fairway La., Alliance, OH (US) 44601

( * ) Notice: Under 35 U.S.C. 154(b), the term of this patent shall be extended for 0 days.

(21) Appl. No.: 09/221,040

(22) Filed: Dec. 28, 1998

Related U.S. Application Data

(60) Provisional application No. 60/081,473, filed on Apr. 10, 1998, provisional application No. 60/082,840, filed on Apr. 23, 1998, and provisional application No. 60/105,442, filed on Oct. 23, 1998.

(51) Int. Cl.[7] ..... A47F 5/08

(52) U.S. Cl. ..... 211/113; 211/124; 223/85

(58) Field of Search ..... 248/309.2, 542, 248/543; 211/85.3, 89.07, 124; 242/389, 395, 397, 396.8, 402, 405, 405.3, 407, 613; 206/225, 279, 292

(56) References Cited

U.S. PATENT DOCUMENTS

| | | | | |
|---|---|---|---|---|
| 1,473,662 | | 11/1923 | Banks | 38/73 |
| 2,153,905 | * | 4/1939 | Yankovitch | 211/123 |
| 3,537,625 | * | 11/1970 | Nuttall | 211/124 |
| 3,967,766 | * | 7/1976 | Hart | 223/85 |
| 4,212,403 | * | 7/1980 | Zeigler | 211/119 |
| 4,465,085 | | 8/1984 | Schopieray | 132/42 |
| 5,269,407 | | 12/1993 | Hall | 206/225 |
| 5,495,997 | * | 3/1996 | Moody | 242/561 |
| 5,526,968 | * | 6/1996 | Larson | 223/85 |
| 5,582,334 | * | 12/1996 | Blazer et al. | 223/85 |

FOREIGN PATENT DOCUMENTS

| | | | |
|---|---|---|---|
| 245879 | 1/1926 | (DE) . | |
| 3145467 | 5/1983 | (DE) | A45D/2/16 |

* cited by examiner

*Primary Examiner*—Anita M. King
*Assistant Examiner*—Gwendolyn Baxter
(74) *Attorney, Agent, or Firm*—Emerson & Associates; Roger D. Emerson; Timothy D. Bennett

(57) ABSTRACT

A device for retaining articles, such as hosiery, is disclosed. A method of retaining the articles using the device is also disclosed. The device generally comprises a first member and retaining means. The article to be retained upon the device is positioned upon the first member, such as by being wound around it.

8 Claims, 6 Drawing Sheets

HOSIERY RETAINING DEVICE AND METHOD

This application claims the benefit of U.S. Provisional Application No. 60/081,473 filed Apr. 10, 1998, and U.S. Provisional Application No. 60/082,840 filed Apr. 23, 1998, and U.S. Provisional Application No. 60/105,442 filed Oct. 23, 1998.

BACKGROUND OF THE INVENTION

1. Field of Invention

This invention relates to the field of storage devices for hosiery, such as sheer hosiery, nylon and silk stockings, thigh highs, tights, opaques, legwear, and pantyhose. The inventive device provides compact storage and easy organization of hosiery, such as pantyhose, stockings, and other items which are difficult to store, organize and retrieve.

2. Description of the Related Art

Hosiery is well known. An exceedingly large variety and quantity of hosiery, whether made of nylon, silk, or other materials, are sold each year worldwide. However, there has been little development in the area of storage and organization of such hosiery. Instead, hosiery is generally put into a drawer and is not organized in any particular manner. In addition, two of the more popular colors for hosiery are navy and black. These colors are often difficult to distinguish in the darkness of a bedroom, especially early in the morning when the wearer is dressing. As such, certain improvements were desired. Many of those improvements have been accomplished by the present invention.

SUMMARY OF THE INVENTION

The present invention permits easy retrieval of hosiery. It prevents tangling and bunching of hosiery in drawers. The device prevents entangling of hosiery with other items packed in a suitcase. The device prevents snagging of hosiery. The device can be made in various colors to allow matching of the device with the color of the hosiery to be secured upon the device. In addition, the device can bear indicia identifying the color of the hosiery to be placed upon the device. The indicia help identify the color of the hosiery, especially in the case of a darkened room, where small gradations in color are difficult to perceive.

BRIEF DESCRIPTION OF THE DRAWINGS

The invention may take physical form in certain parts and arrangement of parts. A preferred embodiment of these parts will be described in detail in the specification and illustrated in the accompanying drawings, which form a part of this disclosure and wherein.

SUMMARY OF THE INVENTION

Figure 1:
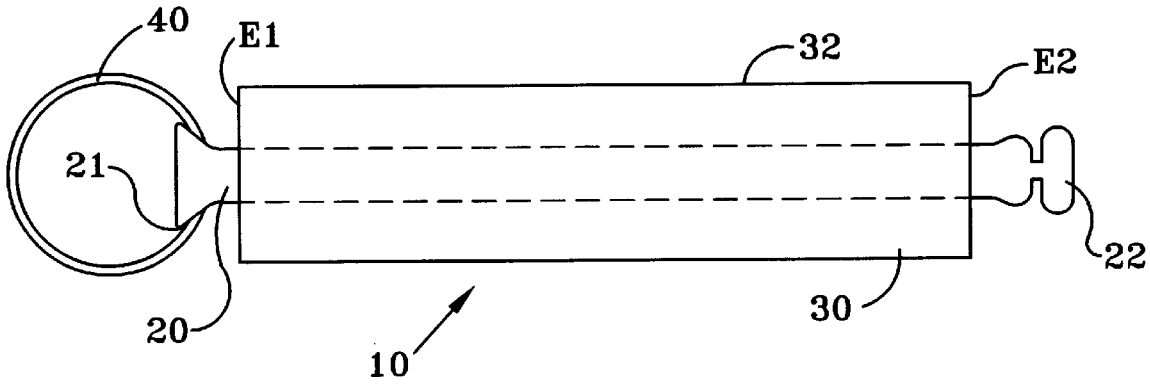
FIG. 1 is a side view of the current invention.
Figure 2:
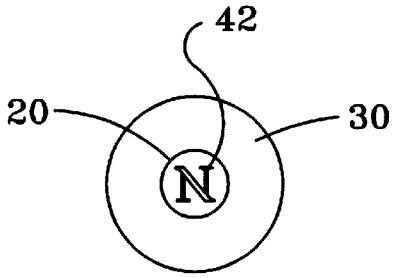
FIG. 2 is an end view of the current invention.
Figure 3:
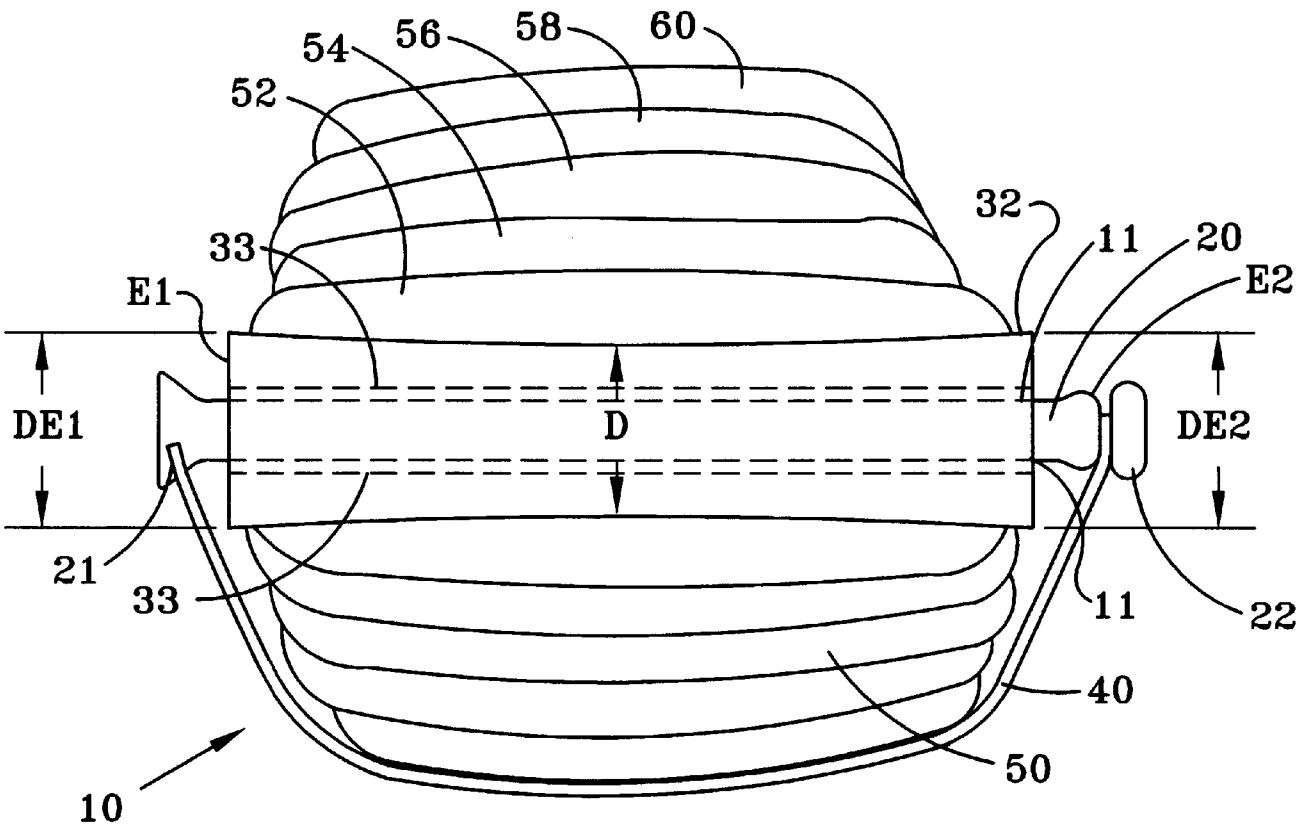
FIG. 3 is an alternative side view of the current invention.

The invention will be described with reference to the enclosed FIGURES. With reference now to FIGS. 1–3, the device 10 generally comprises an inner member 20 and a flexible outer member 30. Preferably, the inner member 20 and outer member 30 are coaxial with the outer surface 11 of inner member 20 and the inner surface 33 of outer member 30 adjacent to one another.

Figure 15:
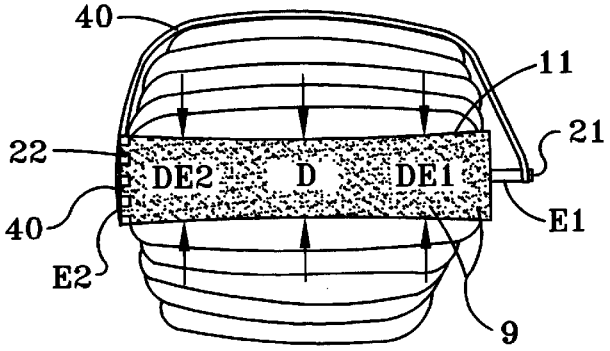
FIG. 15 is a side view of an alternative embodiment of the current invention.

The inner member 20 is preferably manufactured of plastic or some other non-toxic, non-corrosive, inexpensive material. The outer member 30 is preferably made of a soft, deformable material such as foam. By elastically deformable, it is meant that outer member 30 may deform, and then bounce back, when force is applied to it. Preferably, outer member 30 will return to its original shape once the force is no longer applied to it. While the outer member 30 could be made of another non-crushable material, it is somewhat important that the outer member have an appropriate coefficient of friction between its outer surface 32 and the hosiery. While a completely smooth outer surface 32 could work, an outer surface with a higher coefficient of friction between it and the hosiery assists in the winding of the hosiery around the outer member 30. In an alternative embodiment of the present invention outer member 30 can be covered with alternative material provided that the alternative material yields the foregoing objectives. For instance, outer member 30 could be covered with satin. As is shown in FIG. 15, the inner member 20 may comprise frictioning means 9 such as bumps or mildly adhesive agents. Incorporation of the frictioning means 9 into the current invention may result in the outer member 30 being unnecessary. Thus, the hosiery could be wound around the inner member 20. Alternatively, frictioning means 9 may help to retain the outer member 30 to the inner member 20.

Figure 18:
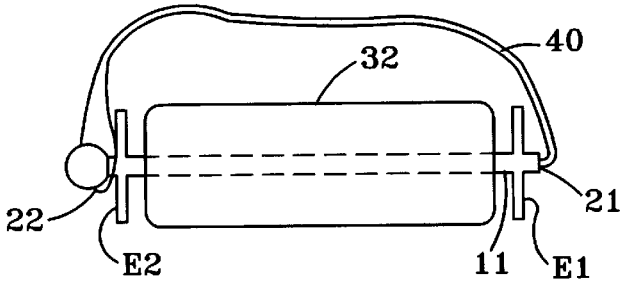

Outer member 30 may alternatively be retained to the inner member 20 by other embodiments of the current invention. The preferred embodiment comprises flared ends on the inner member 20. FIGS. 1, 3, 4, 5, 6 and 16 show this preferred embodiment of the current invention. FIG. 18 shows an alternative embodiment of the same.

With reference to FIGS. 1–3, another important element of the device 10 is a retaining means 40. Preferably, retaining means 40 is elastically deformable. The retaining means 40 can take different forms, including a resiliently stretchable piece of plastic made of the same material as the inner member 20. Another form is that of a string-like elastic band, such a rubber band. The preferred embodiment of the retaining means is an elastomeric, resilient, and elastic band coated with some sort of material, such as thread, or fabric, so that it does not tear the hosiery 50. For ease of illustration, in FIG. 3 the retaining means 40 is illustrated thicker than is actually preferred. As the load placed upon the retaining means 40 is fairly light, the strength of the retaining means 40 can also be fairly low. The retaining means 40 is preferably connected to first end portion, E1, of the current invention through first connecting means 21, although connecting means can be utilized.

FIGS. 15, 16, 17 and 18 show alternative embodiments of the current invention. In FIG. 15, retaining means 40 is connected to second end portion, E2, of the current invention by second connecting means 22. Second connecting means 22 may take a variety of forms, such as raised protrusions which frictionally adheres one end of the retaining means 40 to the second connecting means 22. The retaining means 40 depicted in FIG. 15 may be rigid in one embodiment of the current invention.

In such an embodiment, one end of retaining means 40 may be operatively connected to first end portion, E1, of the current invention by way of first connecting means 21 where first connecting means 21 comprises universal joining means.

Figure 16:
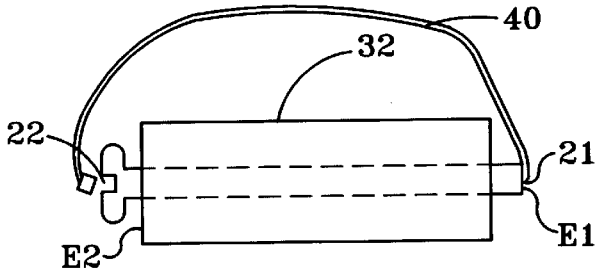
FIG. 16 is a side view of another embodiment of the current invention.
Figure 17:
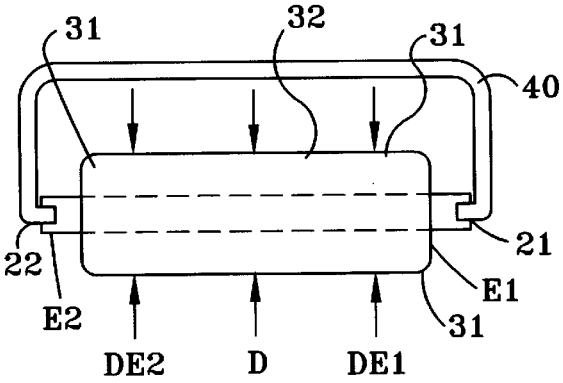
FIG. 17 is a side view of yet another embodiment of the current invention; and, FIG. 18 is a side view of an additional embodiment of the current invention.

FIG. 17 shows an alternative embodiment of the current invention wherein the first connecting means 21 comprises hinging means and the second connecting means 22 comprises snap fitting means. In this embodiment, all or any part of the retaining means 40 may be rigid. In FIG. 16 an alternative embodiment is depicted wherein both the first, 21, and second, 22, connecting means comprise a plug and socket arrangement. FIG. 18 shows an embodiment of the current invention wherein the retaining means 40 is made of an elastomeric material so that it may be stretched over the article and looped over second, 22, connecting means.

Figure 4:
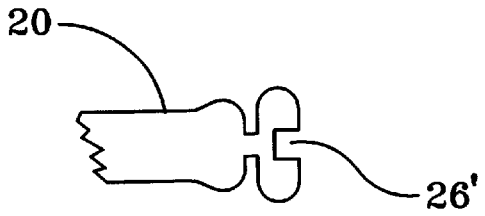
FIG. 4 is a side view of one end portion of the current invention.
Figure 5:
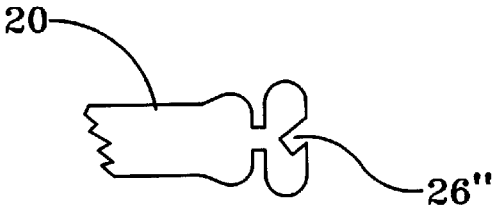
FIG. 5 is an alternative side view of the one end portion of the current invention.
Figure 6:
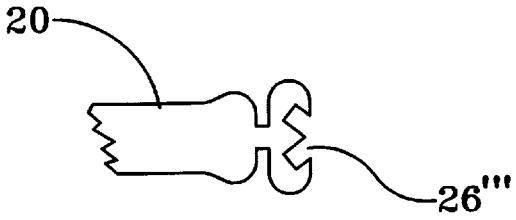
FIG. 6 is yet another side view of one end portion of the current invention.

FIGS. 4, 5 and 6 show alternative embodiments of second connecting means 22. FIG. 4 shows second connecting means 22 comprising an aperture 26'. FIG. 5 shows another embodiment where second connecting means 22 comprises a slanted aperture 26". FIG. 6 shows yet another embodiment where second connecting means 22 comprises a double slanted aperture 26'". Any combination of the foregoing embodiments, arrangements and components of the retaining means 40 and first, 21, and second, 22, connecting means are contemplated by the current invention.

While the size of the device is a matter of design choice and should be chosen with sound engineering judgment depending on the circumstances of each case, generally it is believed that a preferred length L of the device 10 would be about 6 inches long and between 1 inch and 3 inches in diameter D. As shown in FIGS. 3, 15, and 17, first and second end portions, E1 and E2, respectively, have diameters DE1 and DE2, respectively. Diameters DE1 and DE2 are less than or equal to D and are preferably about 0.5 inch. As shown in FIG. 3, inner member 20 preferably has an elongated hourglass shape, with a diameter in the central region D being approximately 0.3 inch. As stated above, second end portion E2 of the current invention may comprise a bulbous extension 24 as second connecting means 22 for receiving retaining means 40.

Figure 7:
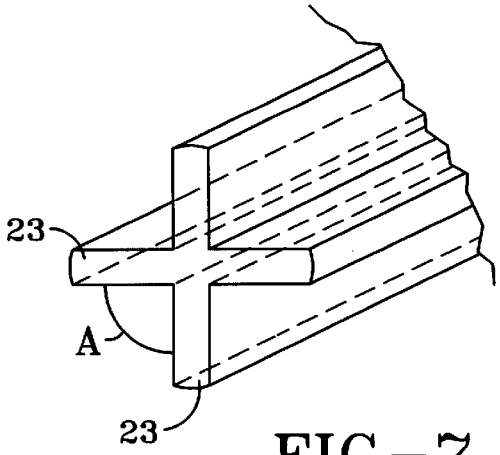
FIG. 7 is a perspective view of the inner member of the current invention.
Figure 8:
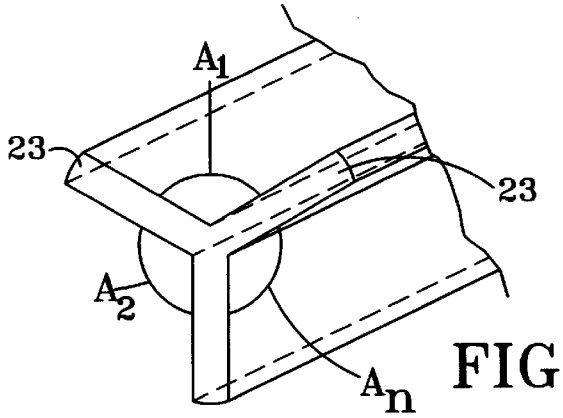
FIG. 8 is a perspective view of an alternative inner member of the current invention.

With reference to FIG. 7, inner member 20 may be configured along its length other than as a round cylinder. For instance, rather than a circle, a cross section of inner member 20 may be a cross-shape, bearing four portions 23, with each portion 23 being separated from an adjacent portion 23 by angle A, wherein angle A is about 90°. Alternatively, a cross section of the inner member 20 may reveal that the inner ember 20 has three portions 23, separated by angle A, wherein angle A is about 120°. This embodiment is depicted in FIG. 8. The current invention envisions an inner member 20 having any number of multiple linear portions 23. The current invention further envisions multiple linear portions 23 having various configurations and separations, such as different angles Al through An, where none of the angles are equal or only some of the angles are equal.

Figure 9:
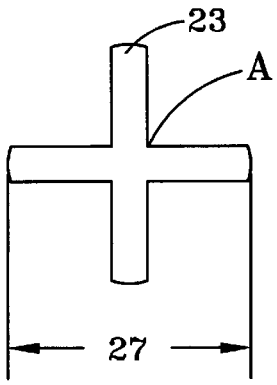
FIG. 9 is a cross section of the inner member of the current invention.
Figure 10:
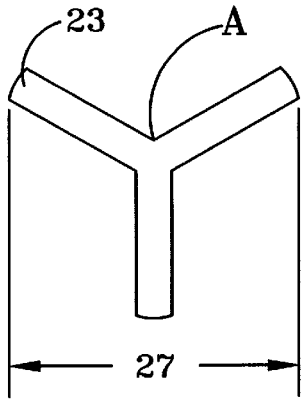
FIG. 10 is a cross section of an alternative inner member of the current invention.
Figure 11:
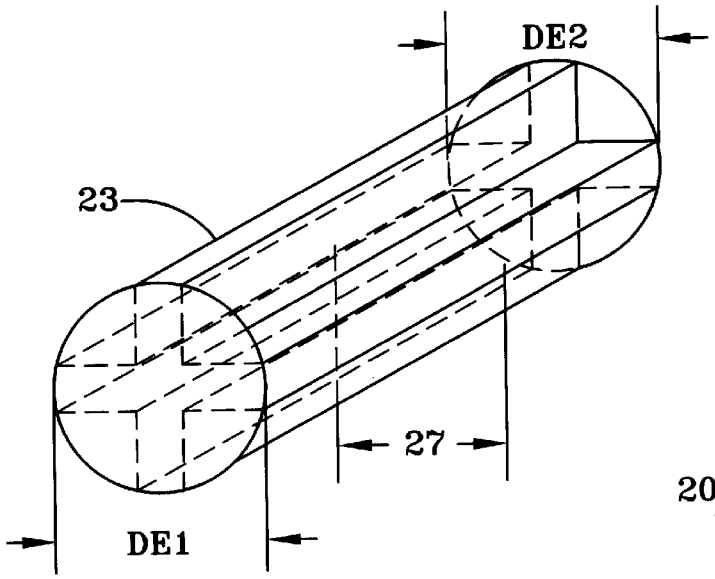
FIG. 11 is a perspective view of the inner member of the current invention.
Figure 12:
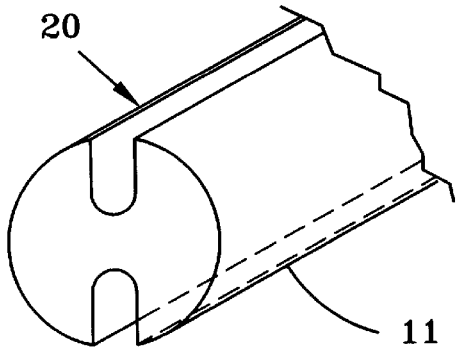
FIG. 12 is a perspective view of an alternative inner member of the current invention.
Figure 13:
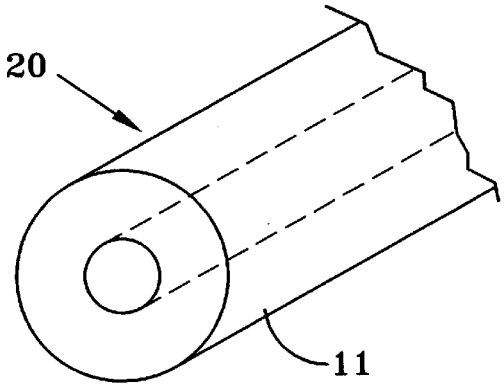
FIG. 13 is a perspective view of another alternative inner member of the current invention.
Figure 14:
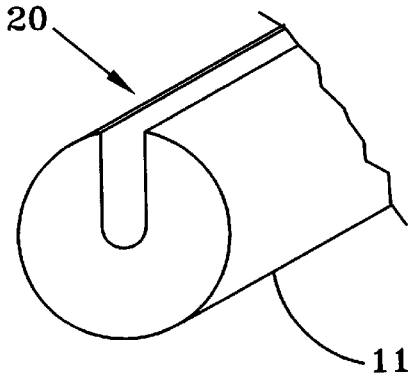
FIG. 14 is yet another perspective view of an alternative inner member of the current invention.

Preferably, regardless of the configuration of the inner member 20, the diameter in the central region of inner member 20 is approximately 0.3 inches and the diameters of the end portions DE1 and DE2 are each approximately 0.5 inches. These central and end diameters are depicted as 27, DE1 and DE2, respectively in FIGS. 9, 10 and 11. FIGS. 12, 13 and 14, respectively, depict alternative embodiments of inner member 20 wherein inner member 20 has two cross slits, a hollow core and a single cross slit.

With reference to FIG. 2, indicating means 42 can be placed at different locations on the device 10 to assist the user in identifying an attribute or characteristic of the hosiery placed thereon, such as the color of the hosiery. For example, as illustrated in FIG. 2, the letter "N" has been placed on the second end portion E2 of the current invention. It is envisioned that the letter "N" could be written in white or luminous material so that the user is better able to identify the color of hosiery in a darkened room. For example, the letter "N" could refer to the color "navy" and therefore help the user identify that navy hosiery, not black hosiery, is wound upon the device 10.

The method of use of the innovative device 10 will now be discussed. The retaining means 40 is loosened at the second end portion E2 of the device 10. One end of the hosiery 52 is laid adjacent to the outer surface 32 of the outer member. The hosiery 50 is then wound around the outer member 30 in successive layers 54, 56, 58, 60 until the second end of the hosiery is reached. At this point, the retaining means 40 is connected by second connecting means 22 to the second end portion E2 of the device 10.

While either end of the hosiery 50 may be wound around the outer member 30 first, so that the other end of the hosiery 50 ultimately faces out and is contacted by retaining means 40, it is preferred that the foot portion of the hosiery 50 be laid upon the surface 32 of the outer member 30 first and that the buttocks and upper thigh portion of the hosiery 50 ultimately faces out and is contacted by retaining means 40. This is preferred because typically the buttocks and upper thigh portions of hosiery are reinforced and/or contain more padding thus offering more protection to the hosiery while it is stored in and subject to rearrangement in a dresser drawer. This ultimately results in increased longevity of the hosiery.

In another embodiment of the invention, the inner member 20 and/or the outer member 30 or any other portion of the device 10 may be scented and/or contain an antiodor, deodorizing and/or odor absorbing agent. Additionally, antimicrobial, disinfecting and/or antibacterial agents may be incorporated into the current invention. These agents are preferably incorporated into the outer member 30 and/or inner member 20.

With reference to FIG. 17, in yet another variation of the current invention, outer member 30 may have tapered ends 31. Outer member 30 may take a variety of configurations and forms provided that the hosiery is able to be wound around it.

Still other benefits and advantages of the invention will become apparent to those skilled in the art to which it pertains upon a reading and understanding of the following detailed specification. For instances, it is within the scope of the current invention to use the current invention with the storage of neckties, socks, or belts by winding them around the current invention. Additionally, the current invention contemplates any such similar application and embodiment of the current invention.

While the invention has been described in connection with specific embodiments and applications, no intention to restrict the invention to the examples shown is contemplated. It will be apparent to those skilled in the art that the above methods may incorporate changes and modifications without departing from the general scope of this invention. It is intended to include all such modifications and alterations insofar as they come within the scope of the appended claims or the equivalents thereof.

Having thus described the invention, it is now claimed:

1. A hosiery retaining device for organizing and storing an associated hose, comprising:

an inner member having first and second ends and an outer surface;

an outer member having a generally tubular shape with an opening along the length of said outer member, said outer member having an outer surface for use in retaining an associated hose, said outer surface of said inner member being received with in said opening in said outer member;

retaining means for use in retaining the associated hose to said outer surface of said outer member, said retaining means including an elastically extendable band-like member having first and second ends, said first end of said band-like member being fixedly attached to said first end of said inner member, said second end of said band-like member being selectivity extendable into attachment with said second end of said inner member;

a first connector fixedly attached to said second end of said band-like member, said first connector for use in connecting said second end of said band-like member to said second end of said inner member; and, wherein said second end of said inner member has an opening for use in receiving said first connector.

2. A hosiery retaining device for organizing and storing an associated hose, comprising:

an inner member having first and second ends and an outer surface, said inner member having a generally circular cross section and being rigidly fashioned, said inner member having a length L1, said second end having a groove formed on an outer periphery of said second end of said inner member for receiving a retaining means;

an outer member having a generally tubular shape with an opening along the length of said outer member, said outer member being deformable and having an outer surface for use in retaining an associated hose, said outer surface of said inner member being received with in said opening in said outer member, said outer member having a length L2 wherein L2 is less than L1;

said retaining means for use in retaining the associated hose to said outer surface of said outer member, said retaining means including an elastically extendable band-like member having first and second ends, said first and second ends of said band-like member being fixedly attached to said first end of said inner member for being selectivity extendable into attachment with said groove on said second end of said inner member.

3. The hosiery retaining device of claim 2 wherein said outer member is deformable and has an outer surface formed of a non-toxic foam.

4. A hosiery retaining device for organizing and storing an associated hose, comprising:

an inner member having first and second ends and an outer surface, said inner member having a generally circular cross section and being rigidly fashioned, said inner member having a length L1, said second end of said inner member having a first connection opening having a circular cross section for receiving a connecting fitting;

an outer member having a generally tubular shape with an opening along the length of said outer member, said outer member being deformable and having an outer surface for use in retaining an associated hose, said outer surface of said inner member being received with in said opening in said outer member, said outer member having a length L2 wherein L2 is less than L1;

a retaining means for use in retaining the associated hose to said outer surface of said outer member, said retaining means being an elastically extendable band-like member having first and second ends, said first end of said retaining means being fixedly attached to said first end of said inner member; and, a connecting fitting fixedly attached to said second end of said retaining means having a circular cross section for connecting to said first connection opening in said second end of said inner member.

5. The hosiery retaining device of claim 4 wherein said connecting fitting snap fits into said first connection opening in said second end of said inner member.

6. The hosiery retaining device of claim 5 wherein said band-like member is an elastomeric string.

7. The hosiery retaining device of claim 6 wherein said band-like member is encased within a fabric material for preventing tearing of the associated hose.

8. The hosiery retaining device of claim 7 further comprising:

indicating means for use in indicating and organizing the associated hose type, said indicating means being a scent infused into said outer member for use in aromatically indicating the type of hose stored retained on said hosiery retaining device.

* * * * *